US006968820B2

(12) United States Patent
Park

(10) Patent No.: US 6,968,820 B2
(45) Date of Patent: Nov. 29, 2005

(54) CONTINUOUS VARIABLE SUCTION SYSTEM

(75) Inventor: Jong-Bum Park, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 122 days.

(21) Appl. No.: 10/749,241

(22) Filed: Dec. 30, 2003

(65) Prior Publication Data

US 2005/0031463 A1 Feb. 10, 2005

(30) Foreign Application Priority Data

Sep. 8, 2003 (KR) ..... 10-2003-0062659

(51) Int. Cl.[7] ..... F02M 35/10

(52) U.S. Cl. ..... 123/184.55
(58) Field of Search ..... 123/184.55

(56) References Cited

*Primary Examiner*—Noah P. Kamen
(74) *Attorney, Agent, or Firm*—Morgan Lewis & Bockius LLP

(57) ABSTRACT

A continuous variable suction system wherein the inner rotor is additionally installed at the inner side of the outer rotor to increase the variable scope of the suction runner length such that the runner length of an optimal suction air passage per speed and load of an engine can be embodied to enhance the engine's performance. A dual rotor structure is formed to reduce the volume of the inner rotor, thereby decreasing the size of the surge tank, whereby lightness of the suction system can be realized and the manufacturing cost can be also saved by minimizing the size of the suction system.

6 Claims, 5 Drawing Sheets

CONTINUOUS VARIABLE SUCTION SYSTEM

CROSS-REFERENCE TO RELATED APPLICATIONS

This application claims priority of Korean Patent Application No. 10-2003-0062659, filed on Sep. 8, 2003, the disclosure of which is incorporated fully herein by reference.

FIELD OF THE INVENTION

The present invention relates to a continuous variable suction system and, more particularly, to a continuous variable suction system adapted for use with a dual rotor to embody the optimum suction runner length in response to the rotating speed and the load of an engine, thereby improving the engine's performance.

BACKGROUND OF THE INVENTION

Conventionally, a so-called variable suction system, in which the suction runner length supplied to the combustion chamber is varied in response to the operating state of an engine, serves to lengthen the suction runner at a low speed and on a low load to increase the inertia force for an increased efficiency, and to shorten a suction runner at a high speed and on a high load to reduce the suction resistance for an increased efficiency.

In order to make the suction runner variable, the surge tank and the suction manifold are increased in size, and the surge tank and the suction manifold are formed in a compact external size, if possible, in terms of engine room layout.

SUMMARY OF THE INVENTION

The present invention provides a continuous variable suction system adapted to obtain a variable scope of the suction runner length under a wide range and simultaneously to reduce the size of the surge tank and suction manifold, thereby providing an optimum suction runner in response to the operating condition of the engine and an efficient engine compartment layout.

In accordance with a preferred embodiment of the present invention, the continuous variable suction system comprises the suction housing formed at one side thereof with an inlet for introducing intake air and formed at a peripheral surface of the suction housing with an outlet communicating with the combustion chamber of an engine. An inner rotor is shaped like a hollow cylinder and rotatably provided in the suction housing and formed at a peripheral surface thereof with an outlet for discharging air. An outer rotor is so positioned in the suction housing as to circumferentially form an air passage between the inner rotor and the suction housing, and formed at a peripheral surface thereof with an outlet for discharging air. Baffles are respectively provided inside the suction housing and the outer rotor to circumferentially form helical suction passages. An inner rotor guide and an outer rotor guide respectively protrude into the outer rotor and the suction housing at the inner rotor and the outer rotor to thereby block a circumferential flow passage between the baffles. A rotational force transferring means is connected from the inner rotor to the outer rotor to transfer rotational force.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENT

The preferred embodiment of the present invention will now be described in detail with reference to the annexed drawings, where the present embodiment is not limiting the scope of the present invention but is given only as an illustrative purpose.

Figure 1:
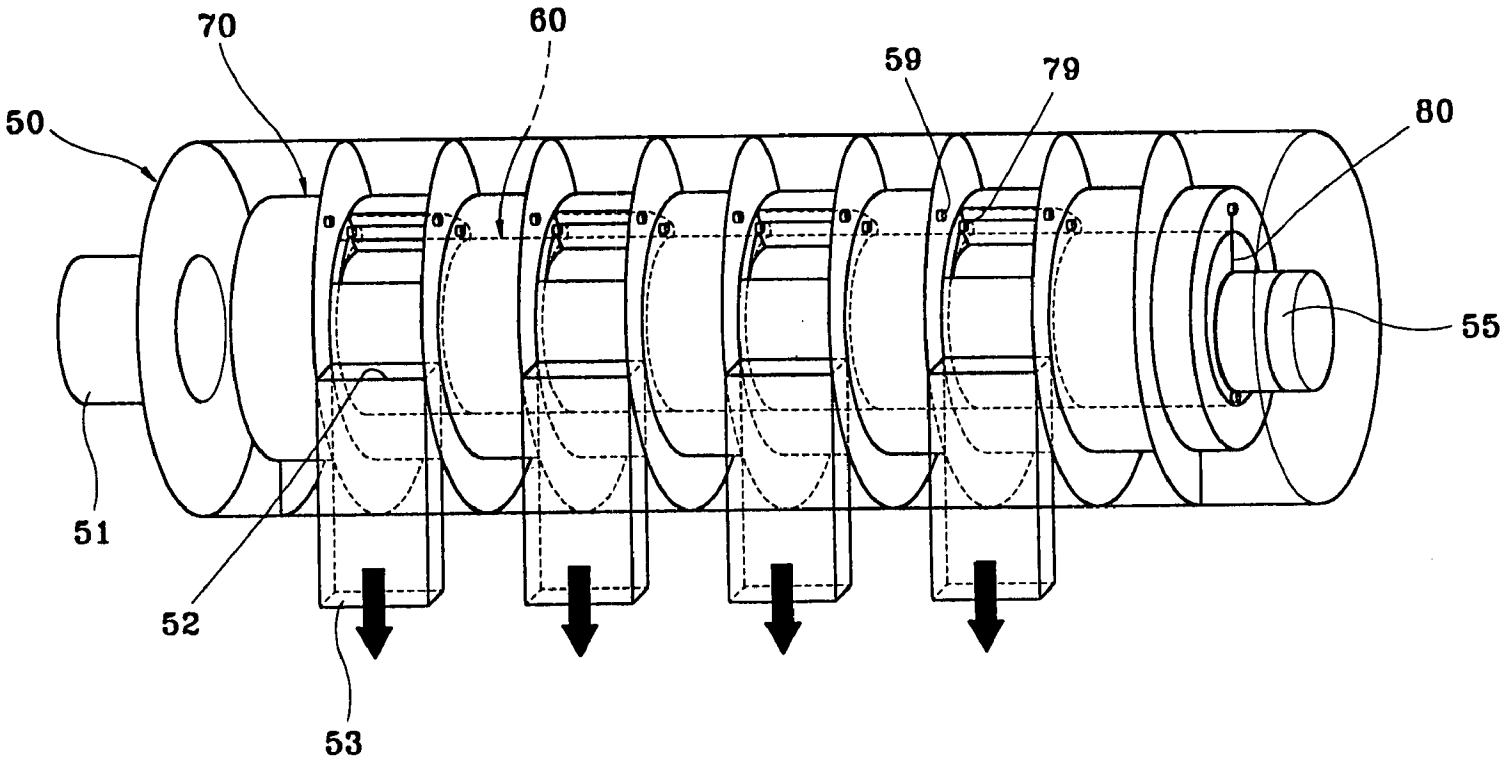
FIG. 1 is a perspective view for illustrating a continuous variable suction system according to an embodiment of the present invention.
Figure 2:
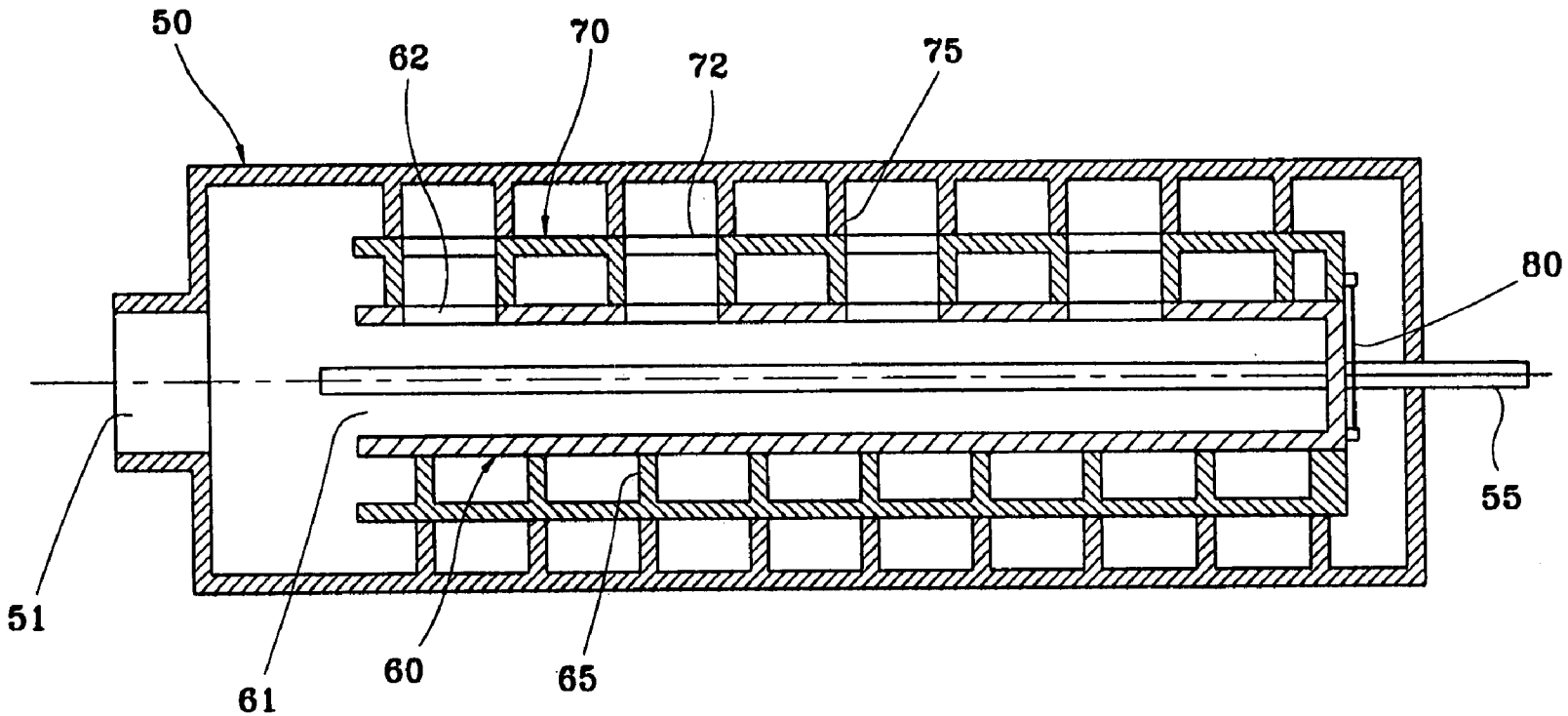
FIG. 2 is a longitudinal cross-sectional view for illustrating a continuous variable suction system according to an embodiment of the present invention.
Figure 3:
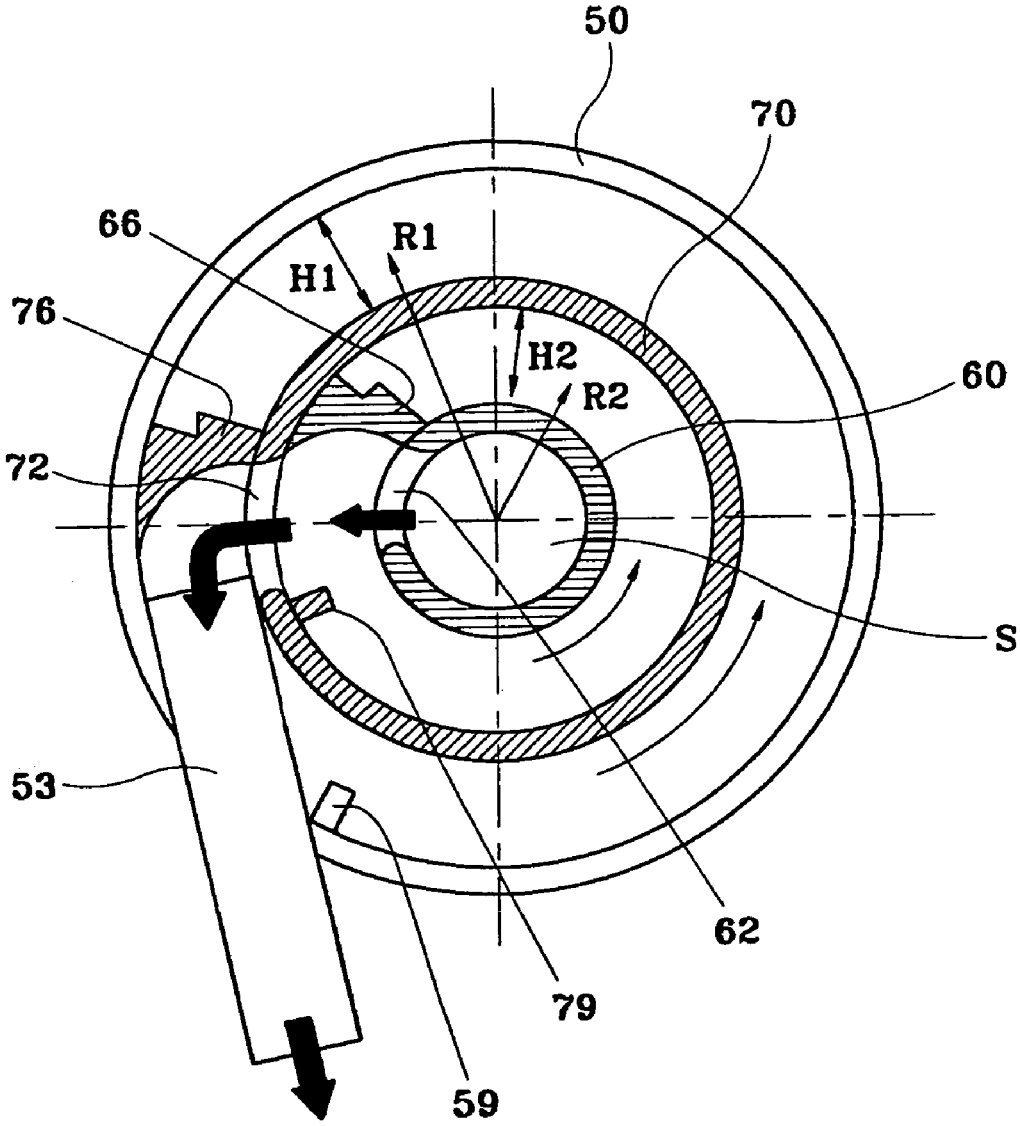
FIG. 3 is a constitutional drawing of a minimum runner length in a continuous variable suction system according to an embodiment of the present invention.

Referring to FIGS. 1, 2 and 3, the continuous variable suction system according to an embodiment of the present invention includes an inner rotor 60 and an outer rotor 70 to form a dual air passage in the suction housing 50. The suction housing 50, the inner rotors 60 and outer rotors 70 have inlets 51, 61 and outlets 52, 62, 72 for allowing air to be introduced and discharged.

The inlet 51 for introducing intake air is formed at one side of the suction housing 50. A plurality of outlets 52 are circumferentially formed along the suction housing 50 parallel with the inlet 51.

The outlet 52 is connected to a fixed runner 53 for providing the intake air to the engine combustion chamber. A helical baffle 75 toward a peripheral direction of the outer rotor 70 is formed along the inner circumferential surface of the suction housing 50.

The inner rotor 60, shaped like a hollow cylinder which functions as a surge tank, is rotatably formed in the suction housing 50 and is circumferentially formed with the outlet 62 for discharging air. The inner rotor 60 is disposed toward the inlet 51 of the suction housing 50 with the opened inlet 61. The inner rotor 60 is fixed to a motor shaft 55 connected to the suction housing 50 for rotation.

The outer rotor 70 is positioned in the suction housing 50 to circumferentially form an air passage between the inner rotor 60 and the suction housing 50 and is circumferentially formed with an outlet 72. A helical baffle 65 facing toward a peripheral direction of the inner rotor 60 is formed along the inner circumferential surface of the outer rotor 70.

Figure 5:
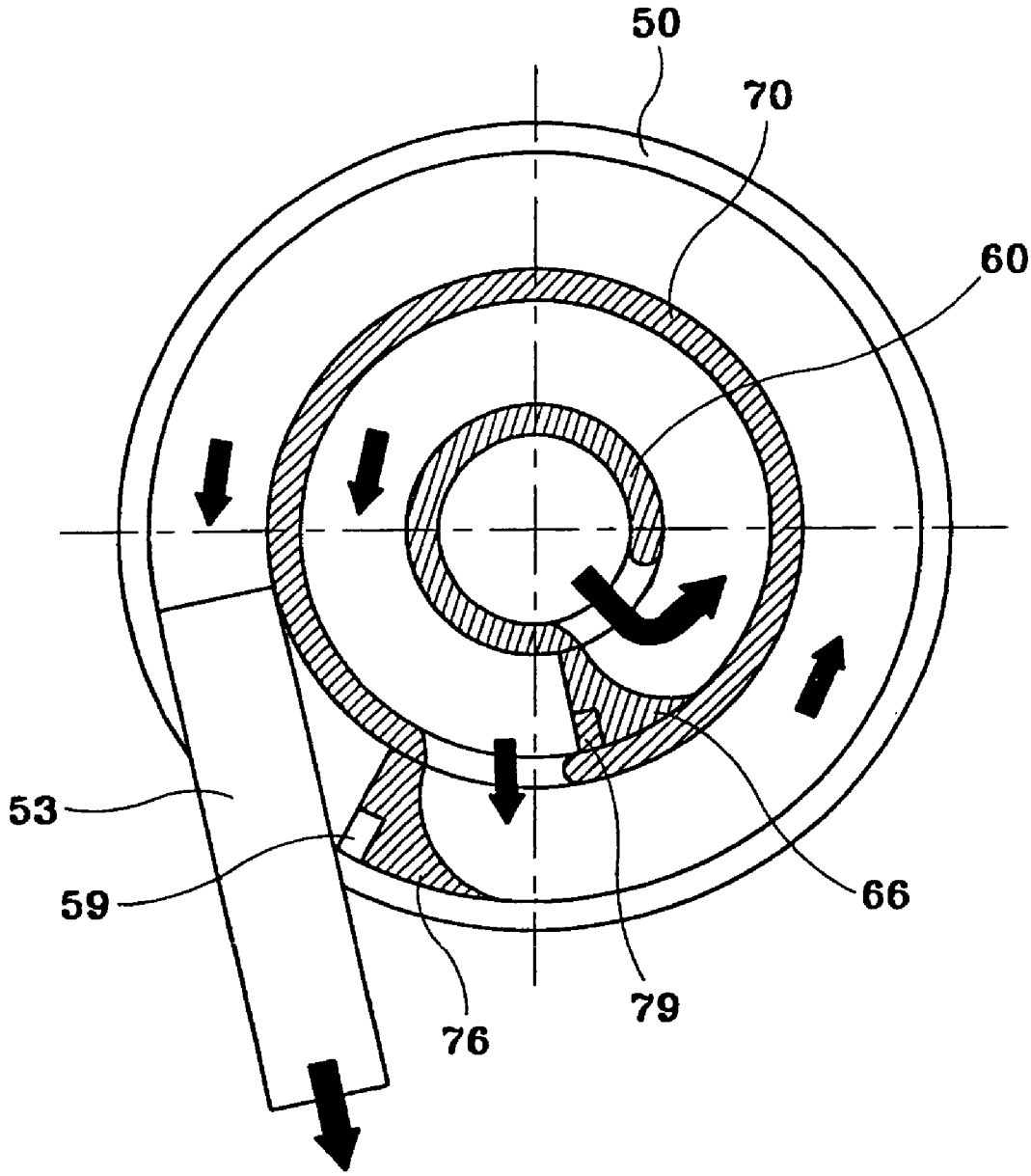
FIG. 5 is a constitutional drawing of a maximum runner length in a continuous variable suction system according to an embodiment of the present invention.

Next, referring to FIG. 5, the inner rotor 60 and the outer rotor 70 are circumferentially formed with inner and outer rotor guides 66, 76, each protruding toward an inner circumferential direction of the outer rotor 70 and the suction housing 50 for blocking the air passage from the circumferential direction between the helical baffles 65, 75.

Furthermore, stoppers 79 and 59 for restricting the rotation scope of the inner rotor 60 and the outer rotor 70 are respectively formed along the inner circumferential surface and lateral surface of the outer rotor 70 and the suction housing 50.

Meanwhile, between the inner rotor 60 and the outer rotor 60, there is a rotational force transferring means for transferring the rotational force of the inner rotor to the outer rotor within a predetermined scope. The rotational force transferring means includes a resilient member 80 connected from the shaft 55 for rotating the inner rotor 60 to the outer rotor 70. Preferably, the resilient member 80 is made of a rubber member, a coil spring, or the like.

Figure 4:
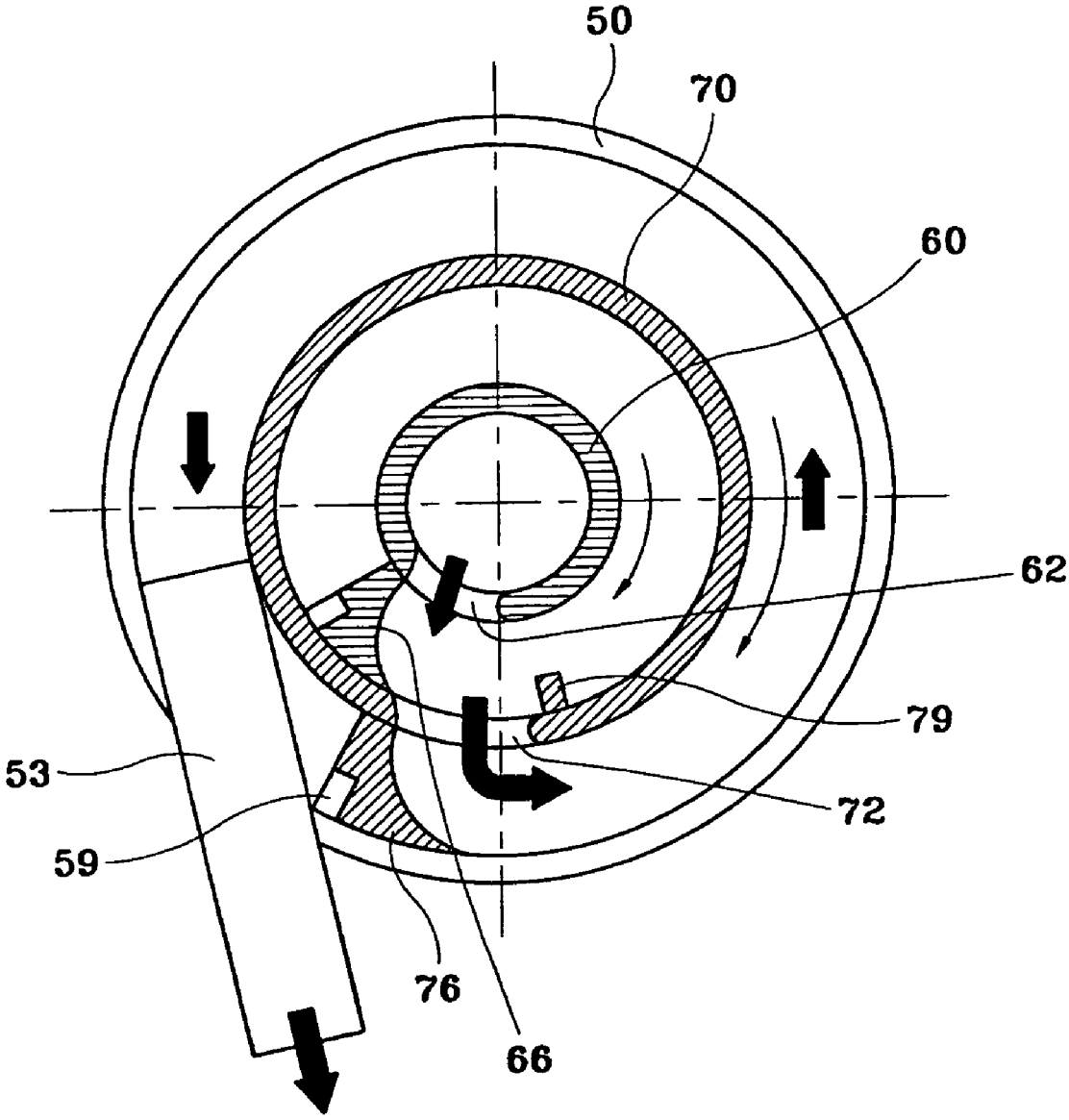
FIG. 4 is a constitutional drawing of an inner rotor and an outer rotor rotating simultaneously in a continuous variable suction system according to an embodiment of the present invention.

In other words, rotation of the two rotors 60 and 70 is effected by a motor shaft 55 directly connected to the inner rotor 60. The inner rotor 60 and outer rotor 70 are connected by the resilient member 80 such that when there is a small rotational force, the inner rotor 60 and outer rotor 70 are integrally rotated as shown in FIG. 4. But when the outer rotor 70 is hitched by the stopper 59, only the inner rotor 60 is rotated.

In an embodiment of the present invention, the variable scope of the suction runner length is very large. The cross-sectional area of the variable runner embodied by the outer rotor 70 and the cross-sectional area of the variable runner embodied by the inner rotor 60 can be differently set up, as depicted in FIG. 3.

Generally, as illustrated in FIG. 3, since the radius of the curvature (R1) of the outer runner is larger than that (R2) of the inner runner, it is advantageous to use the outer runner for high speed and use the inner runner for low speed.

Consequently, it is advantageous that the height (H1) of the outer runner is made higher than that (H2) of the inner runner. A larger cross-sectional area for the variable runner is obtained by integrally rotating the inner and outer rotors 60 and 70 at a high speed, and the length thereof is made variable. Preferably, it is advantageous for the inner rotor 60 to be additionally rotated while the length of the outer runner is maximized at a low speed to additionally embody an inner variable runner of a small cross-sectional area.

For example, if the maximum radius of the suction system formed on an engine room layout is approximately 200 mm, then the maximum length is 500 mm, H1=H2=40 mm, and each wall is 3 mm for a high output of an engine, R1=77 and R2=34. If the rotational scope of the inner and outer runners is 260 degrees, sufficient variable lengths of respectively 350 mm and 154 mm can be obtained.

Next, the operation of the continuous variable suction system as constructed above will be described.

Referring again to FIG. 3 which features a minimum runner length, outlets 62, 72 of the inner and outer rotors 60, 70 are so positioned as to be directly connected to an entry of the fixed runner 53 such that the shortest oil passage can be formed from the center of the surge tank (S) to the fixed runner 53.

Referring to FIG. 4, the inner and outer rotors 60 and 70 are integrally rotated clockwise from the state of FIG. 3 to allow a variable runner to be formed between the suction housing 50 and the outer rotor 70.

Referring to FIG. 5, only the inner rotor 60 is rotated clockwise from the state of FIG. 4, to allow a second variable runner to be formed between the outer rotor 70 and the inner rotor 60, thereby forming a maximum runner length.

Because the stopper 59 is disposed at the inner side of the suction housing 50, the outer rotor 70 cannot be rotated clockwise over the stopper's 59 position in FIG. 4 by the stopper. Likewise, the stopper 59 disposed inside the outer rotor 70 prevents the inner rotor 60 from rotating over the stopper's 59 position in FIG. 5.

It should be noted that for the convenience of explanation of the present invention's operation, according to the basic position of FIG. 3, a length change of the dual variable runner is explained only by the rotation of the inner and outer rotors 60 and 70 and rotation of the inner rotor.

However, it is advantageous to control the length of the runner in an actual engine by rotating the inner rotor 60 in a clockwise direction to reduce the length state of the runner in FIG. 5 to that of a runner in FIG. 4 and by rotating the inner and outer rotors 60, 70 in a clockwise direction to reduce the length state of the runner in FIG. 4 to that of the runner of FIG. 3, where the maximum runner length state of FIG. 5 is given as the basic state.

In case there is a small engine displacement, the required cross-sectional area of the suction pipe is small, but the required length is long. Under this circumstance, in order to satisfy suction conditions of low, intermediate, and high speeds, it is necessary to have a runner length of large variable scope. In the suction system of the present invention, the inner rotor 60 is mounted onto the inner side of the outer rotor 70 to provide a runner length of a large variable scope such that the suction condition necessary in a small engine displacement as described above can be also satisfied.

As apparent from the foregoing, there is an advantage in the continuous variable suction system as described according to an embodiment of the present invention in that the inner rotor is additionally installed at the inner side of the outer rotor to increase the variable scope of the suction runner length such that the runner length of the optimal suction oil passage per speed and load of the engine can be embodied to enhance the engine's performance.

There is another advantage in that the dual rotor structure reduces the volume of the inner rotor, thereby decreasing the size of the surge tank such that lightness of the suction system can be realized and the manufacturing cost can be also saved by minimizing the size of the suction system when compared with other conventional suction systems that provide the same variable scope of the suction runner.

The foregoing description of the preferred embodiment of the present invention has been presented for the purpose of illustration and description. It is not intended to be exhaustive or to limit the invention to the precise form disclosed, and modifications and variations are possible in light of the above teachings or may be acquired from practice of the invention. It is intended that the scope of the invention be defined by the claims appended hereto and their equivalents.

What is claimed is:

1. A continuous variable suction system comprising:

the suction housing formed at one side of said suction housing with an inlet for introducing intake air and formed at a peripheral surface of said suction housing with an outlet communicating with the combustion chamber of an engine;

an inner rotor shaped of a hollow cylinder and rotatably provided in said suction housing and formed at a peripheral surface of said rotor with an outlet for discharging air;

an outer rotor positioned in the suction housing for circumferentially forming an air passage between said inner rotor and said suction housing, and formed at a peripheral surface of said rotor with an outlet for discharging air;

baffles respectively formed inside said suction housing and said outer rotor to circumferentially form helical suction passages;

an inner rotor guide and an outer rotor guide respectively protruding into said outer rotor and said suction housing at said inner rotor and said outer rotor to thereby block a circumferential air passage between said baffles; and a rotational force transferring means connected from said inner rotor to said outer rotor to transfer rotational force.

2. The system as defined in claim 1, wherein the outlet of said suction housing is connected to a fixed runner to provide suction air to the combustion chamber of an engine.

3. The system as defined in claim 1, wherein said outer rotor and said suction housing are respectively disposed with stoppers for restricting the rotational scope of said inner rotor and said outer rotor.

4. The system as defined in claim 1, wherein said inner rotor is opened to an inlet direction of said suction housing.

5. The system as defined in claim 1, wherein said inner rotor is connected to a shaft of a motor inserted into an interior of said suction housing for rotation.

6. The system as defined in claim 1, wherein said rotational force transferring means is a resilient member connected from a shaft for rotating said inner rotor to said outer rotor.

* * * * *